US008519629B2

(12) United States Patent
Tsai

(10) Patent No.: US 8,519,629 B2
(45) Date of Patent: Aug. 27, 2013

(54) LIGHTING DEVICE

(75) Inventor: Wen-Kuei Tsai, Taipei (TW)

(73) Assignee: Top Energy Saving System Corp., New Taipei (TW)

( * ) Notice: Subject to any disclaimer, the term of this patent is extended or adjusted under 35 U.S.C. 154(b) by 301 days.

(21) Appl. No.: 13/095,683

(22) Filed: Apr. 27, 2011

(65) Prior Publication Data

US 2012/0176046 A1 Jul. 12, 2012

(30) Foreign Application Priority Data

Jan. 11, 2011 (TW) ..... 100100898 A

(51) Int. Cl.
*H05B 37/02* (2006.01)

(52) U.S. Cl.
USPC ..... 315/185 R; 315/297; 315/307

(58) Field of Classification Search
USPC ..... 315/113, 185 R, 192, 291, 297, 307–309, 315/312
See application file for complete search history.

(56) References Cited

U.S. PATENT DOCUMENTS

| | | | | |
|---|---|---|---|---|
| 6,798,341 | B1 * | 9/2004 | Eckel et al. | 340/521 |
| 2011/0118890 | A1 * | 5/2011 | Parsons | 700/295 |
| 2012/0081005 | A1 * | 4/2012 | Lin et al. | 315/86 |
| 2012/0306370 | A1 * | 12/2012 | Van De Ven et al. | 315/113 |
| 2013/0063027 | A1 * | 3/2013 | Recker et al. | 315/86 |

* cited by examiner

*Primary Examiner* — Don Le
(74) *Attorney, Agent, or Firm* — Stout, Uxa, Buyan & Mullins, LLP

(57) ABSTRACT

The present invention is directed to a lighting device. A lighting unit includes at least one lighting string, and each lighting string includes one or serial-connected lighting elements. An AC/DC power converter converts an AC voltage to a DC voltage, therefore providing a current to the lighting unit. In one embodiment, a detecting unit performs detection to generate a detect signal; in another embodiment, a brightness adjusting unit, after adjustment, generates adjust signals that represent different brightness modes respectively. Subsequently, a resistor network generates a control signal according to the detect signal or the adjust signal, and a switch unit controls the brightness of the lighting unit according to the control signal.

20 Claims, 4 Drawing Sheets

LIGHTING DEVICE

CROSS-REFERENCE TO RELATED APPLICATIONS

The entire contents of Taiwan Patent Application No. 100100898, filed on Jan. 11, 2011, from which this application claims priority, are incorporated herein by reference.

BACKGROUND OF THE INVENTION

1. Field of the Invention

The present invention generally relates to a lighting device, and more particularly to a light-emitting diode (LED) lighting device with automatic detection and brightness control.

2. Description of Related Art

Due to various advantages of a light-emitting diode (LED) such as small volume, short response time, low power consumption, high reliability and high feasibility of mass production, the LED is replacing conventional lighting devices such as light bulbs or fluorescent lamps.

LEDs may replace conventional lighting devices in most applications, and may further perform functions not available in the conventional lighting devices. For example, a motion, detector may be used in places not being regularly frequented, such as a garage or courtyard, to detect moving object. The light source will be automatically turned on or the brightness be increased whenever the moving object has been detected; otherwise, the light source will be turned off or the brightness be decreased to save power. Such automatic detection and brightness control technique may be applied to not only the conventional lighting devices but also the LEDs. However, a complex and expensive control circuit, such as a microprocessor, is commonly used in the automatic brightness control system.

The brightness of some conventional lighting devices such as incandescent bulbs or energy saving bulbs may be adjusted, while the brightness of other conventional lighting devices such as fluorescent tubes cannot be adjusted. The brightness adjusting schemes of the conventional lighting devices or LEDs are commonly devised on their lamp holders. Accordingly, a special lamp holder need be purchased beforehand to acquire the brightness adjusting function. Moreover, the brightness adjusting system normally uses the complex and expensive control circuit, such as a microprocessor or dimmer.

For the reason that conventional lighting devices or LEDs could not be flexibly used in some applications and are limited due to high cost or expensive price, the conventional lighting devices thus could not be widely accepted by consumers. Accordingly, a need has arisen, to propose a simple but effective automatic control scheme adaptable to LED light source to expand application scope and reduce cost and price.

SUMMARY OF THE INVENTION

In view of the foregoing, it is an object of the embodiment of the present invention to provide a lighting device with detection function for automatically adjusting brightness or manually adjusting brightness, being independent of lamp holder. Moreover, the brightness is adjusted by a control scheme simpler than the conventional lighting devices.

According to a first embodiment, a lighting device includes a lighting unit, an AC/DC power converter, a detecting unit, a resistor network and a switch unit. Specifically, the lighting unit includes at least one lighting string, and each said lighting string includes one or a plurality of serial-connected lighting elements. The AC/DC power converter is configured to convert an AC voltage to a DC voltage to provide a current to the lighting unit. The detecting unit is configured to perform detection to generate a detect signal; the resistor network is configured to generate a control signal according to the detect signal; and the switch unit is configured to control brightness of the lighting unit according to the control signal.

According to a second embodiment, a lighting device includes a lighting unit, an AC/DC power converter, a brightness adjusting unit, a resistor network and a switch unit. Specifically, the lighting unit includes at least one lighting string, and each said lighting string includes one or a plurality of serial-connected lighting elements. The AC/DC power converter is configured to convert an AC voltage to a DC voltage to provide a current to the lighting unit. The brightness adjusting unit is configured to generate various adjust signals that represent different brightness modes respectively; the resistor network is configured to generate a control signal according to the adjust signal; and the switch unit is configured to control brightness of the lighting unit according to the control signal.

DETAILED DESCRIPTION OF THE INVENTION

Figure 1:
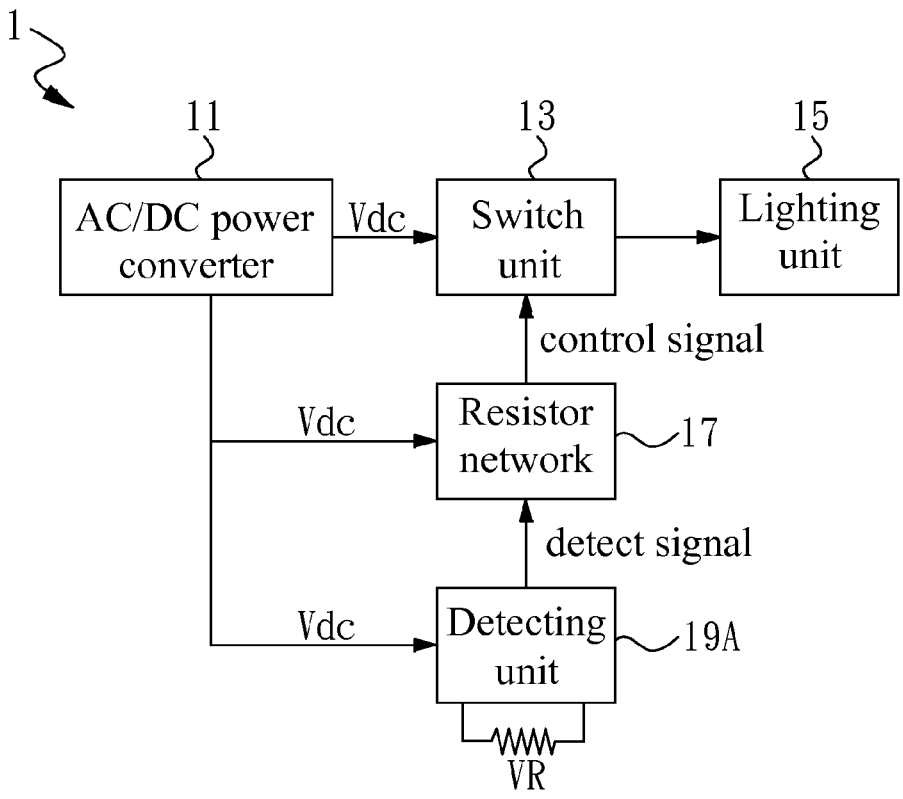
FIG. 1 shows a block diagram of a lighting device according to a first embodiment of the present invention.
Figure 2:
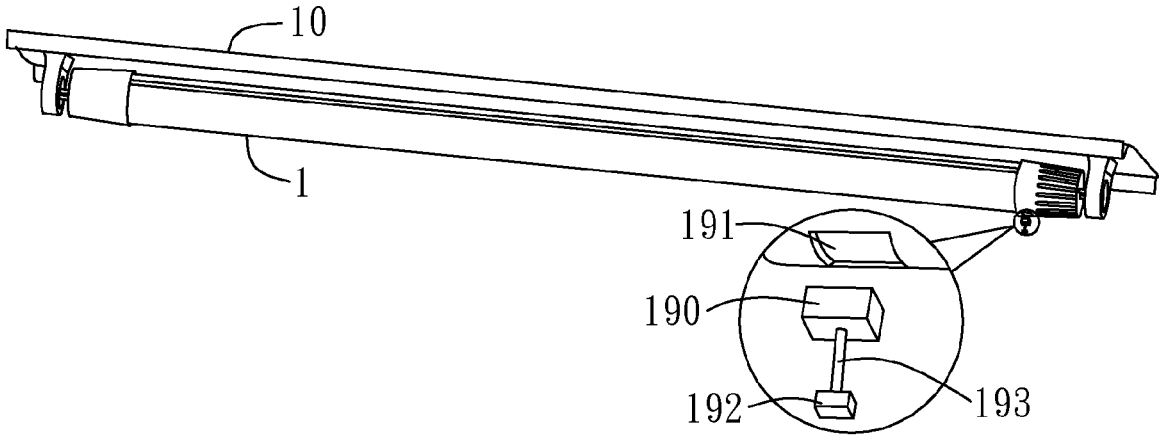
FIG. 2 shows a perspective view of the lighting device and a holder according to a first embodiment.

FIG. 1 shows a block diagram of a lighting device 1 according to a first embodiment of the present invention. In the embodiment, the lighting device 1 is a light-emitting diode (LED) tube, although a lighting element, such as an organic light-emitting diode (OLED), other than the LED may be used as well. FIG. 2 shows a perspective view of the lighting device 1 according to the first embodiment. The lighting device 1 may be placed in a common holder 10 for a fluorescent tube.

In the embodiment, the lighting device 1 primarily includes an AC/DC power converter 11, a switch unit 13, a lighting unit 15, a resistor network 17 and a detecting unit 19A.

The AC/DC power converter 11 converts an alternating-current (AC) voltage, for example, of main electricity to a direct-current (DC) voltage Vdc, which provides required DC current to the lighting unit 15. The AC/DC power converter 11 may be implemented by a variety of schemes such as a bridge rectifier, a filtering capacitor, a transformer or an electric switching power converter.

In the embodiment, the detecting unit 19A is a motion detector, such as a passive infra red (PIR) detector, which may be used to detect moving object (e.g., human or automobile) and accordingly generate a detect signal to the resistor network 17. In a preferred embodiment, the detecting unit 19A is a PIR detecting module, which includes a PIR detector and a timer. In operation, the PIR detecting module receives the DC voltage Vdc provided by the AC/DC power converter 11. The motion detector of the detecting unit 19A generates an active detect signal to the resistor network 17 whenever a moving object is detected. The timer (not shown) inactivates the detect signal when a predetermined period has elapsed, where the predetermined period may be set by a variable resistor VR.

As shown in FIG. 2, the detecting unit 19A of the embodiment is a pluggable detector, which primarily includes a connector 190 and a detector 192. The connector 190 may be plugged into a receptacle 191 disposed on the lighting device 1 (e.g., a lighting tube), and the detector 192 is electrically coupled to the connector 190. Further, an extension part 193 is connected between the connector 190 and the detector 192 such that the detector 192 can be extended to outside of the lighting tube to prevent the heat generated from the lighting tube from affecting the detector 192. The extension part 193 may be made of elastic material such that the detector 192 may be directed to a specific direction by twisting the extension part 193, thereby improving detection accuracy. The extension part 193 may be an extended wire.

In the embodiment, the resistor network 17 (e.g., R-2R resistor ladder) is used for analog-to-digital conversion, and receives the DC voltage Vdc provided by the AC/DC power converter 11. The resistor network 17 generates (digital) control signal to the switch unit 13 according to the detect signal provided by the detecting unit 19A.

The switch unit 13 receives the DC voltage Vdc provided by the AC/DC power converter 11, and then controls the lighting unit 15 according to the control signal provided by the resistor network 17. The switch unit 13 may include a number of switches such as metal oxide semiconductor (MOS) transistors, MOS field effect transistors, power MOS transistors, bipolar junction transistors, relays, solid relays or opto-couplers. In the embodiment, the switch is closed when the control signal is asserted (or "1"); otherwise, the switch is open when the control signal is de-asserted (or "0").

In the embodiment, the lighting unit 15 includes at least one lighting string. Each lighting string includes one or a number of serial-connected lighting elements such as LEDs.

Figure 3:
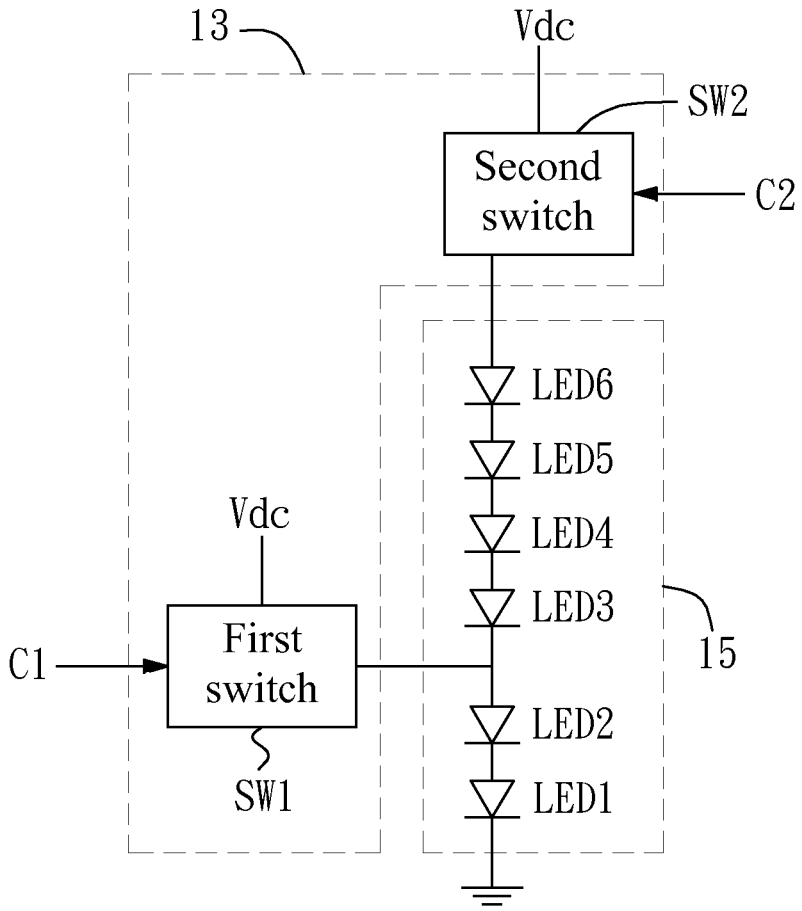
FIG. 3 shows a detailed circuit of the switch unit and the lighting unit according to the first embodiment.

FIG. 3 shows a detailed circuit of the switch unit 13 and the lighting unit 15. According to the figure, the switch unit 13 includes a first switch SW1 and a second switch SW2, and the lighting unit 15 includes an LED string. Specifically, the first switch SW1 is controlled by a control signal C1 provided by the resistor network 17; one end of the first switch SW1 is connected to the DC voltage Vdc provided by the AC/DC power converter 11, and another end of the first switch SW1 is connected to an intermediate node of the LED string. The second switch SW2 is controlled by a control signal C2 provided by the resistor network 17; one end of the second switch SW2 is connected to the DC voltage Vdc provided by the AC/DC power converter 11, and another end of the second switch SW2 is connected to the external anode of the LED string.

According to the circuit shown in FIG. 3, when the detecting unit 19A does not detect any moving object, the resistor network 17 generates a de-asserted (or "0") control signal C2 and an asserted (or "1") control signal C1. Accordingly, the second switch SW2 is open and the first switch SW1 is closed. Therefore, current passes some LEDs (i.e., LED1 and LED2) to illuminate, and the other LEDs (i.e., LED3 to LED6) with no current are dark. When the detecting unit 19A detects a moving object, the resistor network 17 generates an asserted (or "1") control signal C2 and a de-asserted ("0") control signal C1. Accordingly, the second switch SW2 is closed and the first switch SW1 is open. Therefore, current passes all LEDs (i.e., LED2 to LED6) to illuminate. In other words, when the detecting unit 19A detects a moving object, the lighting unit 15 generates full (100%) illumination; when the detecting unit 19A detects no moving object, the lighting unit 15 generates less than total illumination to save power. In another embodiment, when the detecting unit 19A detects no moving object, no current passes LED1 to LED6 and thus gives no illumination.

Figure 4:
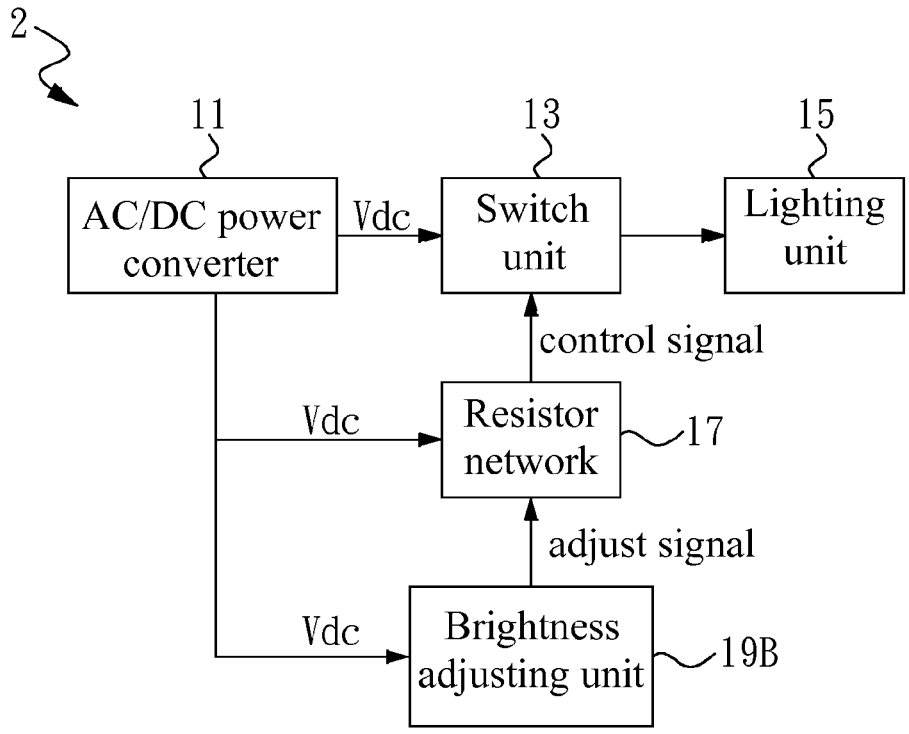
FIG. 4 shows a block diagram of a lighting device according to a second embodiment of the present invention.
Figure 5:
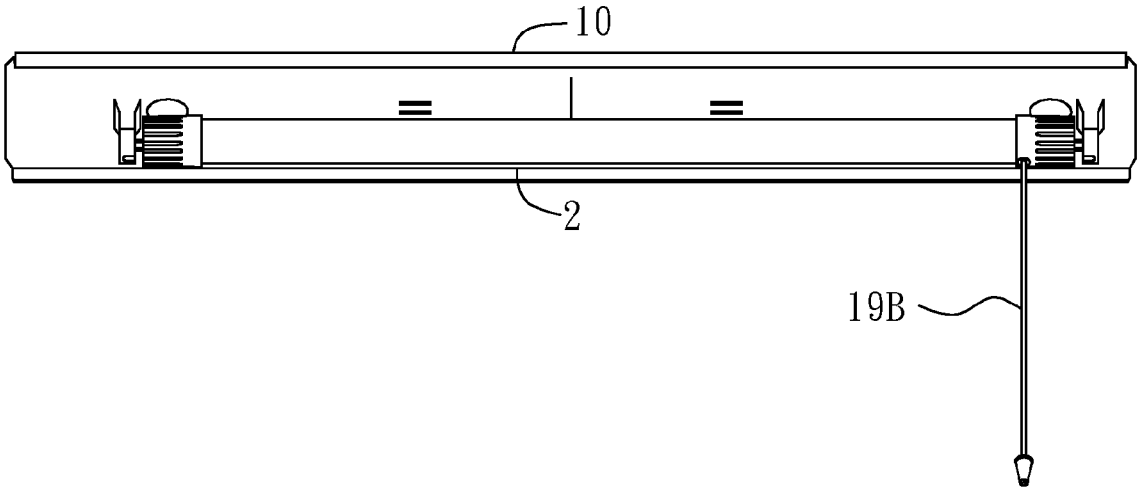
FIG. 5 shows a perspective view of the lighting device and the holder according to the second embodiment.

FIG. 4 shows a block diagram of a lighting device 2 according to a second embodiment of the present invention. Same blocks as in the first embodiment (FIG. 1) are denoted with same numerals. The difference between the present embodiment and the first embodiment is that the detecting unit 19A of the first embodiment is replaced with a brightness adjusting unit 19B. FIG. 5 shows a perspective view of the lighting device 2 and the holder 10 according to the second embodiment.

Similar to the first embodiment, the AC/DC power converter 11 of the present embodiment converts an alternating-current (AC) voltage, for example, of main electricity to a direct-current (DC) voltage Vdc, which provides required DC current to the lighting unit 15. The AC/DC power converter 11 may be implemented by a variety of schemes such as a bridge rectifier, a filtering capacitor, a transformer or an electric switching power converter.

In the embodiment, the brightness adjusting unit 19B is a manual adjuster, which is capable of generating adjust signals to the resistor network 17. The adjust signals represent different brightness modes, such as full (100%) brightness mode, half (50%) brightness mode and night-lamp mode. In operation, the brightness adjusting unit 19B receives the DC voltage Vdc provided by the AC/DC power converter 11. According to different brightness modes, the brightness adjusting unit 19B generates corresponding adjust signals to the resistor network 17.

As shown in FIG. 5, the brightness adjusting unit 19B of the embodiment is a manual adjusting rod, which may be pulled down or rotated to successively enter different brightness modes.

In the embodiment the resistor network 17 (e.g., R-2R resistor ladder) is used for analog-to-digital conversion, and receives the DC voltage Vdc provided by the AC/DC power converter 11. The resistor network 17 generates (digital) control signal to the switch unit 13 according to the adjust signal provided by the brightness adjusting unit 19B.

Similar to the first embodiment, the switch unit 13 receives the DC voltage Vdc provided by the AC/DC power converter 11, and then controls the lighting unit 15 according to the control signal provided by the resistor network 17. The switch unit 13 may include a number of switches such as metal oxide semiconductor (MOS) transistors, MOS field effect transistors, power MOS transistors, bipolar junction transistors, relays, solid relays or opto-couplers. In the embodiment, the switch is closed when the control signal is asserted (or "1"); otherwise, the switch is open when the control signal is de-asserted (or "0").

In the embodiment, the lighting unit 15 includes at least one lighting string. Each lighting string includes one or a number of serial-connected lighting elements such as LEDs.

Figure 6:
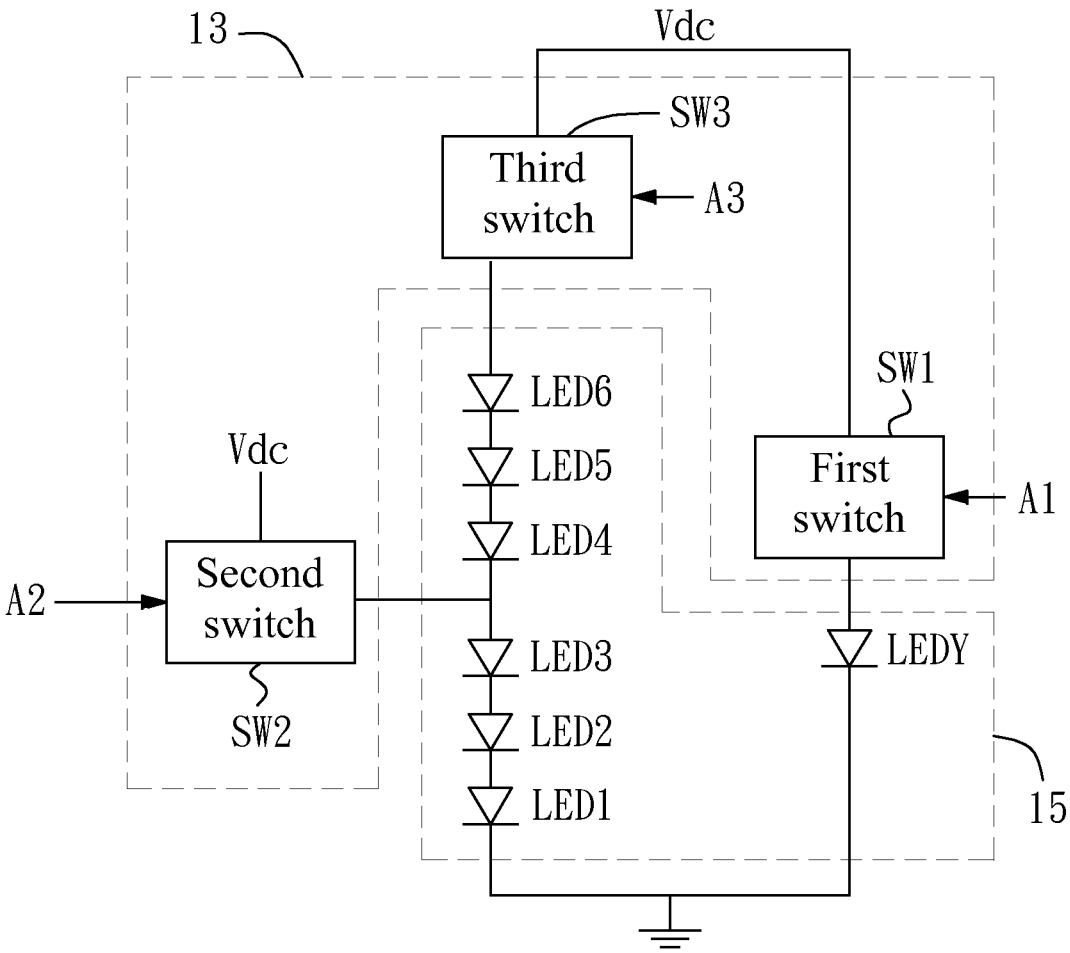
FIG. 6 shows a detailed circuit of the switch unit and the lighting unit according to the second embodiment.

FIG. 6 shows a detailed circuit of the switch unit 13 and the lighting unit 15. According to the figure, the switch unit 13 includes a first switch SW1, a second switch SW2 and a third switch SW3, and the lighting unit 15 includes an LED string (such as white LEDs) and a yellow LED (LEDY). Specifically, the first switch SW1 is controlled by a control signal A1 provided by the resistor network 17; one end of the first switch SW1 is connected to the DC voltage Vdc provided by the AC/DC power converter 11, and another end of the first switch SW1 is connected to the anode of the yellow LED (LEDY). The second switch SW2 is controlled by a control signal A2 provided by the resistor network 17; one end of the second switch SW2 is connected to the DC voltage Vdc provided by the AC/DC power converter 11, and another end of the second switch SW2 is connected to an intermediate node of the LED string LED1-LED6. The third switch SW3 is controlled by a control signal A3 provided by the resistor network 17; one end of the third switch SW3 is connected to the DC voltage Vdc provided by the AC/DC power converter 11, and another end of the second switch SW2 is connected to the external anode of the LED string LED1-LED6.

According to the circuit shown in FIG. 6, when the brightness adjusting unit 19B is set at the full (100%) brightness mode, the resistor network 17 generates de-asserted (or "0") control signals A1/A2, and an asserted (or "1") control signal A3. Accordingly, the first and second switches SW1/SW2 are open and the third switch SW3 is closed. Therefore, current passes all LEDs (i.e., LED1-LED6) to illuminate. When the brightness adjusting unit 19B is set at the half (50%) mode, the resistor network 17 generates de-asserted (or "0") control signals A1/A3, and an asserted (or "1") control signal A2. Accordingly, the first and third switches SW1/SW3 are open and the second switch SW2 is closed. Therefore, current passes some LEDs (i.e., LED1-LED3) to illuminate, and the other LEDs (i.e., LED4-LED6) with no current are dark. When the brightness adjusting unit 19B is set at the night-lamp mode, the resistor network 17 generates de-asserted (or "0") control signals A2/A3, and an asserted (or "1") control signal A1. Accordingly, the second and third switches SW2/SW3 are open and the first switch SW1 is closed. Therefore, current passes the yellow LED (LEDY) to illuminate, and the other LEDs (i.e., LED1-LED6) with no current are dark.

Although specific embodiments have been illustrated and described, it will be appreciated by those skilled in the art that various modifications may be made without departing from the scope of the present invention, which is intended to be limited solely by the appended claims.

What is claimed is:

1. A lighting device, comprising:

a lighting unit including at least one lighting string, each said lighting string including one or a plurality of serial-connected lighting elements;

an AC/DC power converter configured to convert an AC voltage to a DC voltage, to provide a current to the lighting unit;

a detecting unit configured to perform detection to generate a detect signal;

a resistor network configured to generate a control signal according to the detect signal; and a switch unit configured to control brightness of the lighting unit according to the control signal.

2. The lighting device of claim 1, wherein the detecting unit comprises a motion detector configured to detecting a moving object.

3. The lighting device of claim 2, wherein the motion detector is a passive infra red (PIR) detector.

4. The lighting device of claim 2, wherein the detecting unit further comprises a timer, wherein the motion detector generates the active detect signal to the resistor network whenever the moving object is detected, and the timer inactivates the detect signal when a predetermined period has elapsed.

5. The lighting device of claim 4, wherein the detecting unit further comprises a variable resistor used to set the predetermined period.

6. The lighting device of claim 1, wherein the detecting unit is a pluggable detector.

7. The lighting device of claim 6, wherein the pluggable detector comprises:

a connector capable of being plugged into a receptacle of the lighting device; and a detector electrically coupled to the connector.

8. The lighting device of claim 7, wherein the pluggable detector further comprises an extension part connected between the connector and the detector.

9. The lighting device of claim 8, wherein the extension part is capable of being twisted to direct the detector to a specific direction.

10. The lighting device of claim 1, wherein the switch unit comprises a plurality of switches.

11. The lighting device of claim 10, wherein the switch is a metal oxide semiconductor (MOS) transistor, an MOS field effect transistor, a power MOS transistor, a bipolar junction transistor, a relay, a solid relay or an opto-coupler.

12. The lighting device of claim 2, when the detecting unit detects the moving object, the resistor network controls the switch unit in a manner such that the current provided by the AC/DC power converter passes all the lighting elements; when the detecting unit detects no moving object, the resistor network controls the switch unit in a manner such that the current provided by the AC/DC power converter does not pass at least one said lighting element.

13. A lighting device, comprising:

a lighting unit including at least one lighting string, each said lighting string including one or a plurality of serial-connected lighting elements;

an AC/DC power converter configured to convert an AC voltage to a DC voltage, to provide a current to the lighting unit;

a brightness adjusting unit configured to generate various adjust signals that represent different brightness modes respectively;

a resistor network configured to generate a control signal according to the adjust signal; and a switch unit configured to control brightness of the lighting unit according to the control signal.

14. The lighting device of claim 13, wherein the brightness adjusting unit comprises a manual adjuster.

15. The lighting device of claim 13, wherein the brightness modes comprise a full (100%) brightness mode, a half (50%) brightness mode and a night-lamp mode.

16. The lighting device of claim 14, wherein the manual adjuster is a manual adjusting rod, which may be pulled down or rotated to successively enter the different brightness modes.

17. The lighting device of claim 13, wherein the switch unit comprises a plurality of switches.

18. The lighting device of claim 17, wherein the switch is a metal oxide semiconductor (MOS) transistor, an MOS field effect transistor, a power MOS transistor, a bipolar junction transistor, a relay, a solid relay or an opto-coupler.

19. The lighting device of claim 13, when the brightness adjusting unit is set at one of the brightness modes, the resistor network controls the switch unit in a manner such that the amount of the lighting elements having the current provided by the AC/DC power converter passing therethrough is different from the amount of the lighting elements having the current passing therethrough when the brightness adjusting unit is set at another of the brightness modes.

20. The lighting device of claim 13, when the brightness adjusting unit is set at one of the brightness modes, the resistor network controls the switch unit in a manner such that the lighting string having the current provided by the AC/DC power converter passing therethrough is different from the lighting string having the current passing therethrough when the brightness adjusting unit is set at another of the brightness modes.

* * * * *